United States Patent [19]

Phillips

[11] 4,332,184

[45] Jun. 1, 1982

[54] STRINGED MUSICAL INSTRUMENT HAVING A BRIDGE SECURED TO AND TRANSLATABLE ALONG A STRING

[76] Inventor: Peter Phillips, 189 Sackett St., Brooklyn, N.Y. 11231

[21] Appl. No.: 207,943

[22] Filed: Nov. 18, 1980

[51] Int. Cl.[3] ..... G10D 1/00; G10D 3/04

[52] U.S. Cl. ..... 84/173; 84/307; 84/297 R; 84/297 S

[58] Field of Search ..... 84/170, 173, 197–199, 84/284–285, 297–299

[56] References Cited

U.S. PATENT DOCUMENTS

| | | | |
|---|---|---|---|
| 582,030 | 5/1897 | Walker | 84/318 X |
| 3,595,118 | 7/1971 | Paxton | 84/322 |
| 3,780,612 | 12/1973 | Robinson | 84/173 |
| 4,138,919 | 2/1979 | Miller | 84/297 R |
| 4,169,402 | 10/1979 | Wood | 84/291 |

FOREIGN PATENT DOCUMENTS

| | | | |
|---|---|---|---|
| 1349445 | 4/1964 | France | 84/173 |

*Primary Examiner*—Lawrence R. Franklin
*Attorney, Agent, or Firm*—Robert E. Purcell

[57] ABSTRACT

A stringed musical instrument having a plurality of strings stretched over the sounding board of a sounding box includes a corresponding bridge for each string. Each bridge rests on the sounding board and may be translated along the corresponding string to thereby change the functional vibrating length of the string and hence change the pitch of the musical tone produced when the string is set into vibration. Each string passes through a bore extending through the corresponding bridge so that the bridge does not disengage from the corresponding string (and possibly become misplaced or lost) when the bridge is translated, when the string is in a non-stretched condition, or when the instrument is jolted.

7 Claims, 6 Drawing Figures

STRINGED MUSICAL INSTRUMENT HAVING A BRIDGE SECURED TO AND TRANSLATABLE ALONG A STRING

BACKGROUND OF THE INVENTION

There have been many experiments and demonstrations that explain the physics of producing sound, especially musical tones. Some of these experiments and demonstrations include blowing air over the open ends of tubular cavities of varying lengths, changing the tension in a string having a set functional vibrating length, blowing air against a rotating disc having apertures located equiangularly therein, etc.

One of the most popular of such demonstrations is based on experiments conducted by Pythagoras and other ancient Greeks which involved changing the functional vibrating length of a string having a set tension. Pythagoras experimented with a string stretched with a constant tension over a sounding board of a sounding box and supported by a bridge resting on the sounding box. By placing the bridge at various positions along the string, different sounds are perceived when the string is set into vibration.

The ancient Greeks very accurately measured the functional vibrating length of the string, i.e., the distance between the point where the string contacted the bridge and the adjacentmost point where the string was prevented from vibrating, such as a fret contacting the string. The sounds produced by vibrating the string when the bridge is placed at a selected location yielding a first functional vibrating length of the string and thereafter vibrating the string when the bridge is placed at another location yielding a second functional vibrating length were found to have a pleasing relation when the ratio of the first functional vibrating length to the second functional vibrating length was a certain fraction, especially a fraction of small whole numbers, e.g., 2/1, 4/1, 5/2, and 5/3. The Greeks combined sounds having such pleasure relations into a host of scales and composed songs comprising successions of sounds in a certain scale.

The aspect of music theory relating sound to the functional vibrating length of a string having a constant tension may be explained to students with the aid of an instrument similar to that used by the ancient Greeks. To the inventor's knowledge, the bridge used by the ancient Greeks and others prior to the invention disclosed herein comprises a base portion that rests on the sounding board and an apex or top portion supporting, and upon which rests, the stretched string. When instruments with such bridges are used by students, the bridges tend to become disengaged from the strings when the bridges are translated or repositioned along the strings, when the strings are in a non-stretched condition, or when the instrument is subjected to a sudden jolt. Such disengagement ,causes wasted time in re-engaging and properly positioning the bridges and the strings. Furthermore, such disengagement results in many bridges becoming misplaced or lost.

SUMMARY OF THE INVENTION

The present invention overcomes the disadvantages associated with prior moveable bridges for stringed musical instruments by providing a bridge that is prevented from disengaging from a corresponding string.

In the present invention, the string, instead of resting on the top of the bridge, passes through a bore extending through the bridge. Thus, with the present invention the bridge will not disengage from a corresponding string.

For a better understanding of the invention, reference may be made to the following descriptions of representative embodiments, taken in conjunction with the figures of the accompanying drawings in which:

and

Figure 6:
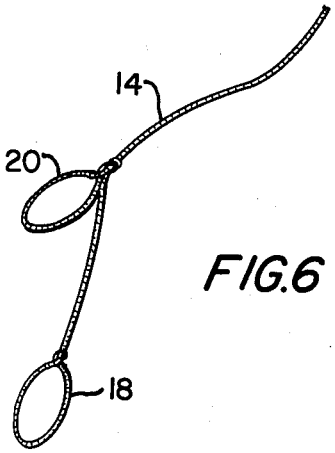

FIG. 6 is an end of a string that may be used in a stringed musical instrument according to the present invention.

DESCRIPTION OF PREFERRED EMBODIMENTS

The preferred embodiment of a stringed musical instrument according to the present invention was designed with the goal of inexpensively providing such an instrument to elementary school students in conjunction with their studies in music theory. Therefore the preferred instrument was simply designed with low cost materials and with the idea that mentally retarded students would fabricate the pieces of the instrument for assembly and playing thereafter by normal students. Consequently, it should be understood that the present invention may be utilized with stringed instruments other than those specifically described herein.

Figure 1:
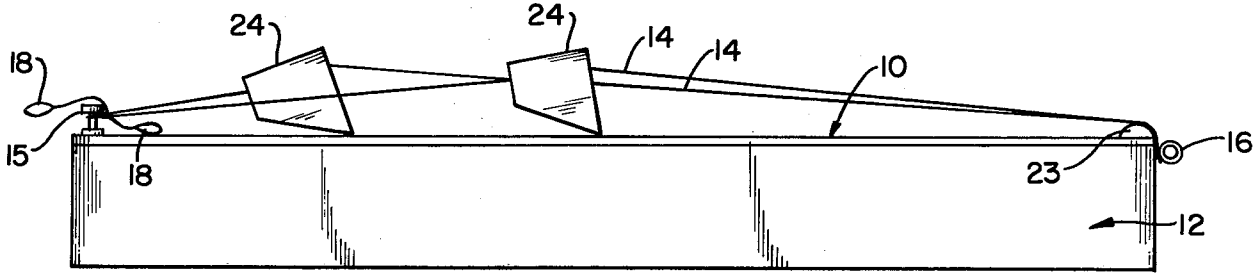
FIG. 1 is a side view of a stringed musical instrument according to the present invention.
Figure 2:
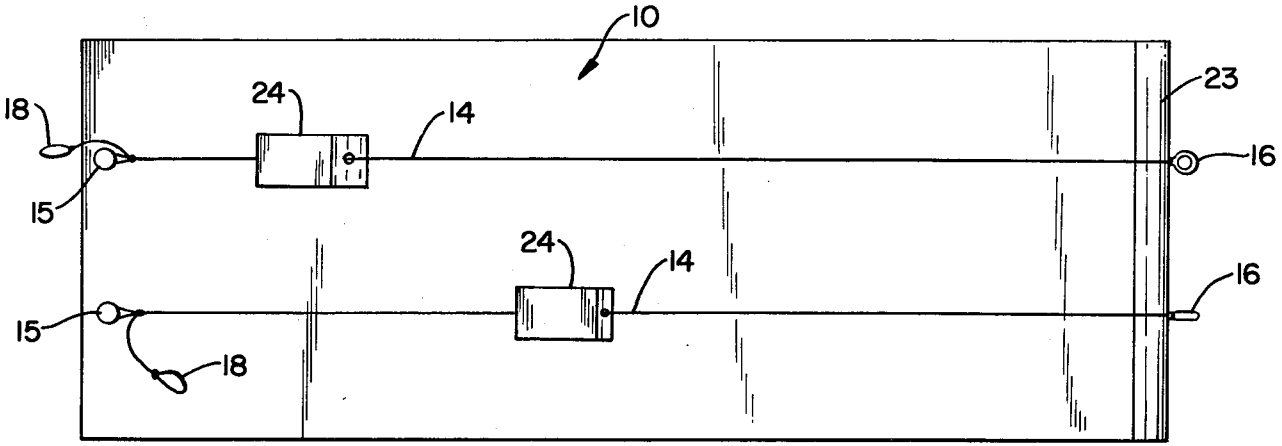
FIG. 2 is a top view of the stringed musical instrument shown in FIG. 1.
Figure 3:
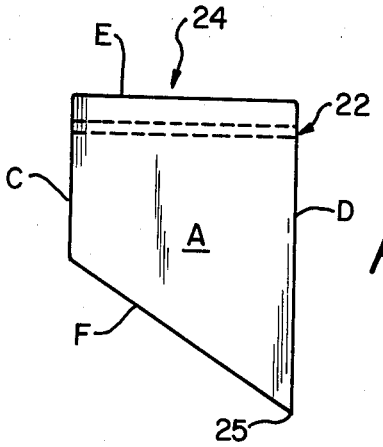
FIG. 3 is a side view of a bridge used in a stringed musical instrument according to the present invention.
Figure 4:
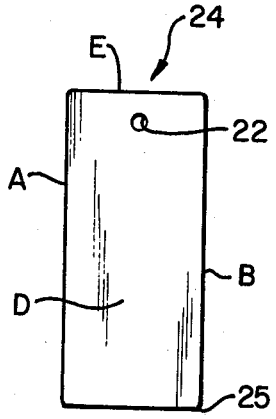
FIG. 4 is an end view of the bridge shown in FIG. 3.

There is shown in FIG. 1 and FIG. 2 a stringed musical instrument including a sounding box having a sounding board 10. The sounding board 10 comprises a rectangular sheet of plywood having a thickness of about one-quarter inch, a length of about twenty-four inches, and a width of about eight inches. The sounding box also includes a side wall 12 located on one side of the sounding board, around the edges thereof. The side wall 12 comprises four pieces of pine wood, each having a width of about two and one-half inches and a thickness of about three-quarters inch. The pieces of the sidewall 12 are secured together and to the sounding board 10 by nails, screws or other appropriate means.

It will thus be appreciated that the sounding box of the preferred embodiment is designed similar to that of a zither. Alternately, the sounding box could be fashioned with a second sheet covering the bottom of and enclosing the sounding box and by providing a large hole through the sounding board 10.

As shown in FIG. 1 and FIG. 2, two strings 14 preferably fashioned of nylon or cellulose fibers, but which may be fashioned of other material such as metal, are stretched over the sounding board 10. Although any number of strings may be utilized in this invention, the preferred number of strings is eight, while two strings are shown for ease and simplicity of description. Each string 14 is stretched between a two-headed nail 15 anchored in the sounding board 10 near an edge thereof and a screw 16 having an eyelet in the head thereof (also known as an eye screw) partially screwed into the side wall 12 near the opposite edge of the sounding board 10.

The preferred manner of stretching each string 14 is also believed to be unique. As shown in FIG. 6, one end of each string 14 is tied into two slightly spaced loops 18, 20. The loop 20 farthest from the string end is looped around a corresponding two-headed nail 15 between the heads thereof. The unlooped string end is threaded through the eye of the screw 16, and the string area immediately adjacent to the screw 16 is marked or otherwise noted. Next, the loop 20 is removed from the two-headed nail, and the string 14 is tied about the screw 16 such that the marked section thereof is in the same relative position as it was when it was marked. Each string 14 is stretched into a taut condition by drawing and looping the loop 20 around the corresponding two-headed nail 15. Such drawing and looping of the loop 20 is difficult to accomplish by hand and may be aided by the use of a metal hook inserted through the loop 18. The string tension may be changed or adjusted by rotation of the screw 16 to which the string 14 is tied.

The musical instrument also includes a fret 23 secured by nails or the like to the end of the sounding board 10 adjacent to the screws 16. The fret 23 is formed of a semi-circular piece of doweling around and against which the tensioned strings 14 rest, thereby restraining oscillations of the strings 14 in the region of the fret 23.

As shown in FIGS. 1 through 4, each bridge 24 is fashioned preferably of wood having two generally parallel surfaces A, B and four sides C, D, E, F generally perpendicular to the parallel surfaces A, B. Sides C and D are generally parallel with each other, side E is generally perpendicular to sides C and D, and side F is inclined with respect to sides C and D, forming an acute angle or apex 25 with side D. The sides C, D, E and F all have a width preferably about three-quarters inch and have lengths preferably of about three-quarters inch, one and five-eights inch, one and one-half inches, and one and three-quarters inches, respectively.

Figure 5:
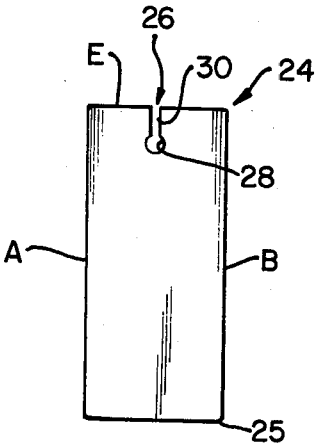
FIG. 5 is an end view of another bridge used in a stringed musical instrument according to the present invention.

Each bridge 24 is provided with a hole or bore 22 therethrough running generally parallel with and adjacent to side E and approximately midway between the parallel surfaces A, B. The bore 22 has a diameter at least as great as the thickness of the corresponding string 14, and preferably only slightly greater than the string thickness so that the string 14 will be substantially prevented from wobbling within the bore 22 when the portion of the string external of the bridge 24 is set into vibration. Thus it will be appreciated that the bridge 24 will remain engaged with the corresponding string 14 even when the bridge is moved along the string, when the string is relaxed to a non-tensioned condition, or when the musical instrument is jolted. A different means of accomplishing the same result is shown in FIG. 5 wherein a channel 26 depends from side E of the bridge 24 approximately midway between the parallel surfaces A, B. The channel 26 includes rounded inner section 28 having a diameter at least as great as the thickness of the corresponding string 14 and in which the string 14 rests and an outer section 30 located between the inner section 28 and the mouth of the channel having a width less than the string thickness. The channel 26 is especially adapted for use with bridges fashioned of a deformable, resilient material such as some rubbers and plastics. With a bridge so fashioned, a force may be applied to spread open the channel so that the outer section 30 is at least as wide as the string. By applicating of such a force the string may be selectively inserted or withdrawn from the channel inner section 28, whereas the absence of such a force will cause a string in the channel inner section 28 to be retained therein.

In operation, each bridge 24 is positioned so that the apex 25 thereof contacts the sounding board 10. The section of a string 14 between the corresponding bridge 24 and the fret 23 is set into vibration by plucking, picking, bowing or the like, which vibration is transmitted through the bridge 24 to the sounding board 10. Thus by transmitting vibrations from the string 14 to the sounding board 10, the bridge 24 of the present invention has the same function as bridges in other stringed musical instruments. Experimentation has revealed that the quality of musical tone produced by the instrument is most clear and crisp, and least dull, when the area of contact between the bridge 24 and the sounding board 10 is minimized. Such minimizing of contact area is accomplished in the present invention by designing the bridge 24 with the apex 25, which produces substantially line contact between the bridge 24 and the sounding board 10. The line contact may be lessened by decreasing the widths of sides F and D, however, these sides should be made sufficiently wide to prevent the bridge 24 from toppling when the corresponding string 14 is plucked, etc. in a normal manner.

As an aid in instructing students in music theory, each bridge 24 may be translated along the corresponding string 14 to vary the functional vibrating length of the string, i.e., the distance between the bridge 24 and the fret 23. Thus, by moving the bridge 24 along the corresponding string 14, the experiments of Pythagoras and other ancient Greeks may be recreated to demonstrate the differences between sounds produced by vibrating a string of constant tension when the string has different functional vibrating lengths.

The pitches (sounds) of a what is now commonly known as a major scale may be played by utilizing eight strings and corresponding bridges on the above-described instrument (Of course, other scales may also be played on the instrument.). This may be done by positioning each of the bridges so that every string has the same functional vibrating length and then turning each screw so that each string is under the same tension. Such positioning and turning will result in the same pitch being sounded when each string is set into vibration. Seven of the bridges are then repositioned to change each string's functional vibrating length such that the strings will produce pitches corresponding to the pitches of a major scale (i.e., do, re, mi, fa, sol, la, ti, do) when set into vibration. Similarly, a chromatic scale may be played by utilizing thirteen strings and corresponding bridges. It will thus be appreciated that an instrument according to the present invention may be used both to teach music theory and to play songs.

Although particular embodiments of the present invention have been described and illustrated herein, it should be recognized that modifications and variations may readily occur to those skilled in the art and that such modifications and variations may be made without departing from the spirit and scope of my invention. Accordingly, all such modifications and variations are included in the scope of the invention as defined by the following claims:

What is claimed is:

1. A stringed musical instrument having a string, a sounding box including a sounding board, means for anchoring the ends of said string, means for providing tension in said string, a self-supporting bridge resting on said sounding board for engaging with and supporting said string, said bridge translatable along said string, and said bridge provided with two edges meeting to form a corner, and wherein said bridge contacts said sounding board through the bridge corner only.

2. The stringed musical instrument according to claim 1 wherein the two edges form an acute angle where they meet.

3. The stringed musical instrument according to claim 2 wherein said bridge makes substantially line contact with said sounding board.

4. The stringed musical instrument according to claim 1 wherein said bridge makes substantially line contact with said sounding board.

5. The stringed musical instrument according to claim 1 wherein said bridge is provided with a bore therethrough, the bore being sufficiently wide to permit said string to pass therethrough.

6. The stringed musical instrument according to claim 1 wherein said bridge is provided with a channel, a first portion of said channel being sufficiently wide to permit said string to pass therethrough, and a second portion of said channel located between said first channel portion and the mouth of said channel and being of a sufficiently small width to prevent said string from moving from a position in said first channel portion to a position outside said channel.

7. The stringed musical instrument according to claim 6 wherein the bridge is formed of a material sufficiently deformable and resilient to permit the selective distension of said second channel portion.

* * * * *